US007426762B2

(12) United States Patent
Dazzi

(10) Patent No.: US 7,426,762 B2
(45) Date of Patent: Sep. 23, 2008

(54) PILLOW SUITABLE FOR WOMEN'S BODY

(76) Inventor: Cecilia Dazzi, Arco S. Margherita, 1-00186 Roma RM (IT)

( * ) Notice: Subject to any disclaimer, the term of this patent is extended or adjusted under 35 U.S.C. 154(b) by 0 days.

(21) Appl. No.: 10/550,487

(22) PCT Filed: Mar. 25, 2003

(86) PCT No.: PCT/IT03/00178

§ 371 (c)(1),
(2), (4) Date: Sep. 5, 2006

(87) PCT Pub. No.: WO2004/084684

PCT Pub. Date: Oct. 7, 2004

(65) Prior Publication Data

US 2007/0089240 A1 Apr. 26, 2007

(51) Int. Cl.
*A47G 9/00* (2006.01)

(52) U.S. Cl. ..... 5/632; 5/630

(58) Field of Classification Search ..... 5/630–632, 5/731, 735, 930, 740, 655.9, 953, 727
See application file for complete search history.

(56) References Cited

U.S. PATENT DOCUMENTS 1,548,728 A * 8/1925 Milam ..... 5/722
1,595,698 A * 8/1926 Wilson ..... 5/630
2,448,427 A * 8/1948 Gordon ..... 280/32.5
2,469,084 A * 5/1949 Schenker ..... 5/728
2,748,838 A * 6/1956 Scholl ..... 297/423.41
2,839,766 A * 6/1958 Hull ..... 5/632
2,911,969 A * 11/1959 Woodward et al. ..... 601/166
3,051,601 A * 8/1962 Schick ..... 428/213
3,289,224 A * 12/1966 Witchel ..... 5/703
3,319,274 A * 5/1967 Upton ..... 5/701
D220,823 S * 5/1971 Howe et al. ..... D6/599
3,885,258 A * 5/1975 Regan ..... 5/727
3,941,418 A * 3/1976 Bernard ..... 297/452.17
3,967,335 A * 7/1976 Rhoads ..... 5/632
3,988,793 A * 11/1976 Abitbol ..... 601/11
4,053,957 A * 10/1977 Regan ..... 5/727
D271,647 S * 12/1983 McLeod ..... D6/596
4,476,594 A * 10/1984 McLeod ..... 5/701
4,596,384 A * 6/1986 Blosser ..... 5/613
RE32,734 E * 8/1988 McLeod ..... 5/722
D309,542 S * 7/1990 Glenn ..... D6/596
5,037,436 A * 8/1991 Heaston ..... 623/7
5,095,569 A * 3/1992 Glenn ..... 5/490
5,371,909 A * 12/1994 McCarty ..... 5/655
5,661,860 A * 9/1997 Heitz ..... 5/632
6,449,788 B1 * 9/2002 Nichols ..... 5/636
D472,679 S * 4/2003 Burington ..... D29/121.1
6,658,681 B2 * 12/2003 Britto et al. ..... 5/655
6,934,988 B1 * 8/2005 Wetzler et al. ..... 5/621

(Continued)

*Primary Examiner*—Robert G Santos
(74) *Attorney, Agent, or Firm*—Browdy and Neimark, P.L.L.C.

(57) ABSTRACT

Pillow (1) suitable for women's body, allowing an easy resting an easy resting to women's chest, keeping breasts separated therebetween and raised, unflattened by the body. The pillow has a donut shape additionally allowing an effective body side support, and it comprises: a substantially oval annular pillow main body (2), having a central opening allowing breast insertion and a resting surface (3) for the chest area surrounding the breast; a pillow secondary body (4) of elongate shape, located transversely to the opening of the main body (2) so as to position itself between the breasts, at the sternum.

16 Claims, 2 Drawing Sheets

U.S. PATENT DOCUMENTS 7,185,378 B2 * 3/2007 Smith ..... 5/642
7,188,381 B2 * 3/2007 Lombert ..... 5/648
7,194,778 B2 * 3/2007 Riach ..... 5/735
2003/0019007 A1 * 1/2003 Spencer ..... 2/24
2007/0089240 A1 * 4/2007 Dazzi ..... 5/630

* cited by examiner

PILLOW SUITABLE FOR WOMEN'S BODY

BACKGROUND OF THE INVENTION

1. Field of the Invention

The present invention relates to a pillow suitable for women's body, i.e. of a type provided with a specific shaping, allowing to rest with the body lying face downwards, i.e. in the 'belly-down' position.

2. Description of the Prior Art

The option of assuming a correct lying position when at rest is of fundamental importance for the psychophysical wellbeing. In particular, the prone position is healthy as it allows the spine to arrange itself according to an adequate posture, forcing vertebrae alignment on a near-horizontal plane.

Moreover, many, who on their own accord adopt it as the more natural and restful, habitually assume this position. Others, for the above reasons, adopt it in search of a posture apt to prevent or cure spine dislocation defects, or since it alleviates cervical, spinal or lumbar pains and pathologies.

Contrarily to its positive indications, a prone position might prove inconvenient to women, entailing a breast flattening under the chest weight. This problem assumes greater relevance with the increase in breast size, without however being necessarily related thereto, as it possesses a subjective character.

In fact, the inconvenience may be related to other factors, like e.g. mastopathies, irritations due to breast-feeding or to the menstrual cycle, after-effects of plastic surgery on breast, of mastectomy or of any other occurrence in the chest area.

In some cases the prone position is absolutely prevented; in other cases a woman tending to fall asleep in such a position senses a discomfort, forcing her to assume a different position, with an entailed marked disturbance of the half asleep and sleeping states that may even partly thwart the effects of rest.

Another drawback is related to breast flattening, leading to the premature formation of wrinkles at the breast side, mainly at the sternum, a blemish that may be evident even with a standard neckline.

In order to at least partially overcome these drawbacks, in some cases there has been adopted a positioning of a normal pillow or of two pillows so as to keep raised the central portion of the torso. This contrivance, while failing to prevent discomfort, leads to a postural deformation of the spine thwarting the benefits related to the prone position. The same drawback occurred with the use of roll-shaped reduced-section pillows to be placed below the breast.

The state of the art also foresees the use of small-size pillows to be placed between the two breasts in a sternal position, kept thereat by a strap system. Apart from the inherent discomfort, said pillow, designed to prevent flattening blemishes, is ineffective when the body at rest tilts on one side, entailing the flattening of one breast and the raising of the other breast and determining an inconvenient pressure onto the sternum that hinders breathing.

Another known pillow shape provides a butterfly-or X-shaped configuration, attainable inflating a suitably shaped flexible container. The center of the X is placed between the breasts, and the arms of the X support the chest.

As in the previous example, there is a drawback related to the shape allowing the body at rest to tilt sideways, anyhow leading to the flattening of one breast. Moreover, the sensation of complete support provided by a traditional pillow is missing.

Other solutions to the problem outlined above envisage specific resting plane or mattress shapes. These examples, mainly adopted for hospital care on surgical patients, are obviously not employable in everyday life.

SUMMARY OF THE INVENTION

The technical problem underlying the present invention is that of providing a pillow suitable for women's body allowing to overcome the drawbacks mentioned with reference to the known art.

Such a problem is solved by a pillow as above specified, comprising:

A substantially oval annular pillow main body, having a central opening allowing breast insertion and a resting surface for the chest area surrounding the breast;

A pillow secondary body of elongate shape, located transversely to the opening of the main body so as to position itself between the breasts, at the sternum.

The main advantage of the pillow according to the invention lies in allowing an easy resting to women's chest, keeping breasts separated therebetween and raised, unflattened by the body. The donut shape of the main body additionally allows an effective body side support.

Advantageously, in a preferred embodiment of the invention, during use said resting surface is raised at the chest diaphragm with respect to the resting surface at the neck zone, in order to decrease the pressure onto the top section of the sternum, thereby facilitating breathing functions. This raising is attained by virtue of a greater thickness of the main body at the diaphragm.

The present invention will hereinafter be described with reference to an embodiment thereof, given by way of example and without limitative purposes and making reference to the annexed drawings, wherein:

DESCRIPTION OF A PREFERRED EMBODIMENT OF THE INVENTION

Figure 2:
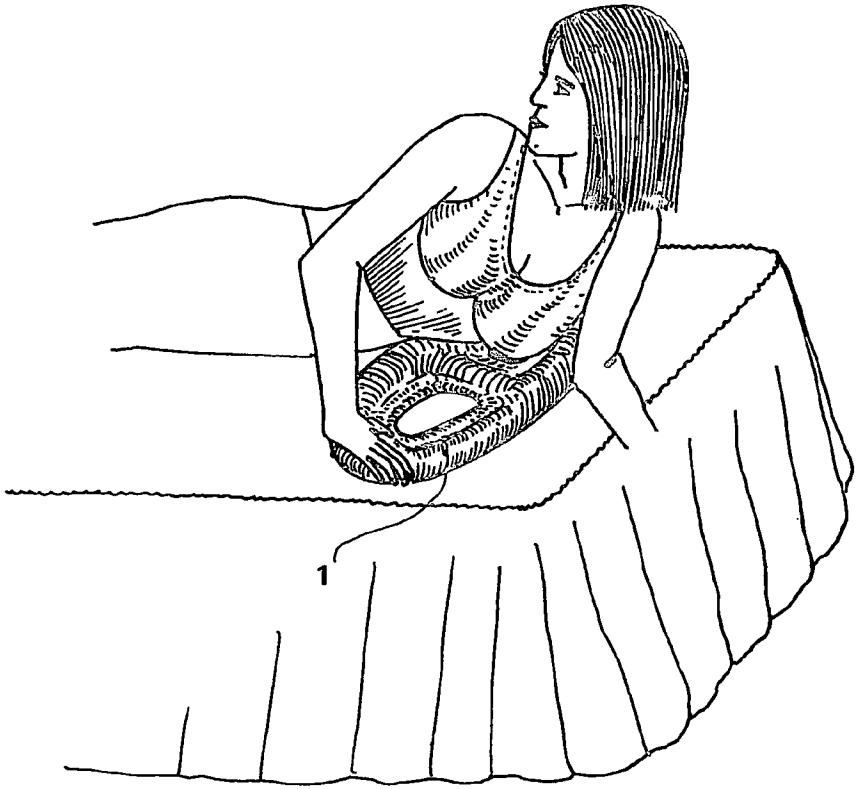
FIG. 2 is a perspective view illustrating the employ of the pillow of FIG. 1.
Figure 1:
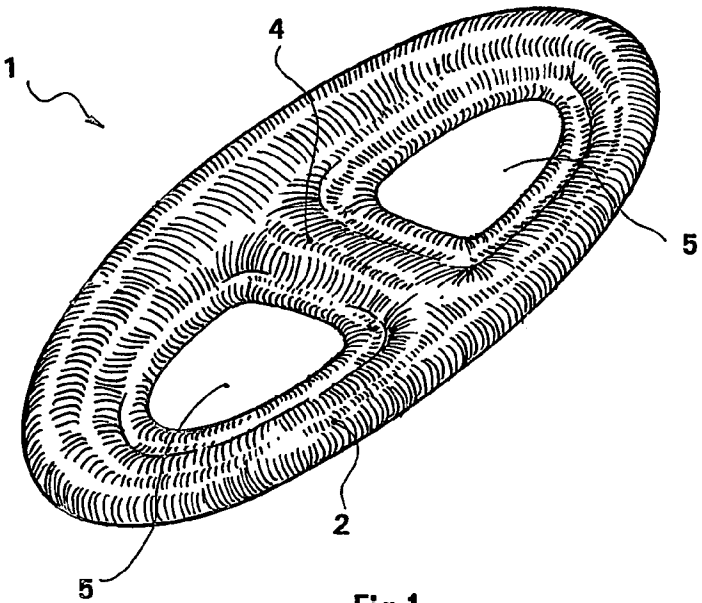
FIG. 1 is a perspective view of a pillow suitable for women's body according to the invention.

With reference to the figures, 1 generally indicates a pillow suitable for women's body. It is substantially 8-shaped or donut-shaped, having a pillow main body 2, of substantially oval annular shape, with a central opening allowing breast insertion and a resting surface 3 for the breast-surrounding chest area.

The pillow 1 further comprises a secondary pillow body 4 of elongate shape, located transversely to said opening of the main body 2 so as to position itself between the breasts at the sternum and determining, in cooperation with the contour of the main body 2, two recesses 5 meant to receive a respective breast.

Figure 3:
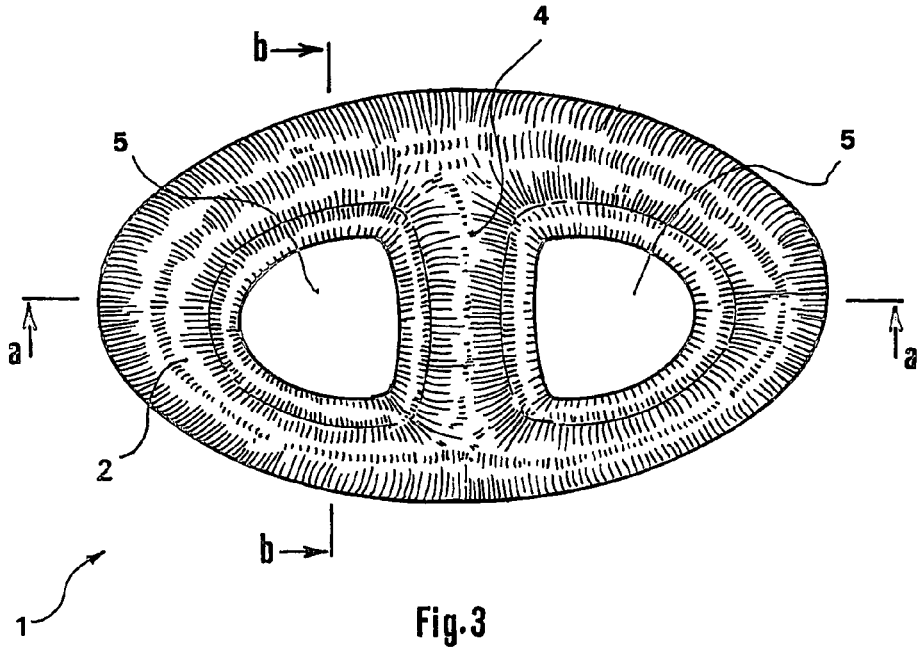
FIG. 3 is a top plan view of the pillow of FIG. 1.
Figure 3A:
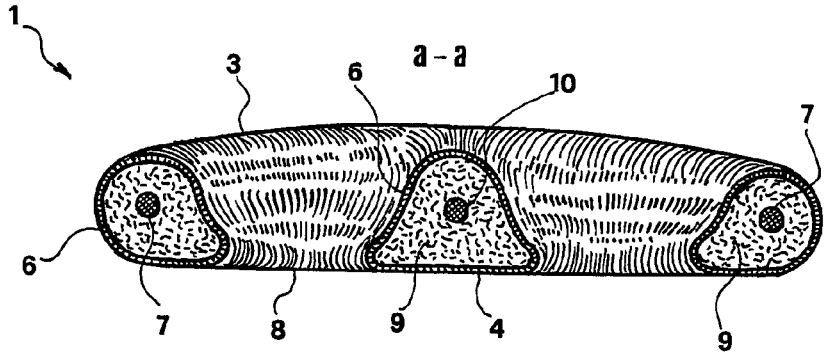
FIG. 3A is a cross-sectional view, taken along line A-A of FIG. 3, of the pillow of FIG. 1.
Figure 3B:
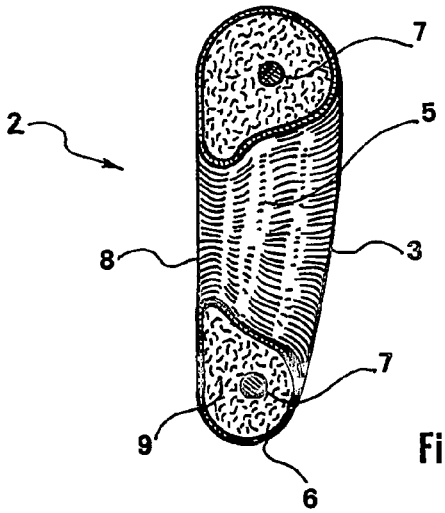
FIG. 3B is a cross-sectional view, taken along line B-B of FIG. 3, of the pillow of FIG. 1.

As it may be appreciated from the section (FIG. 3B), it is provided that, during use of the pillow 1, said resting surface 3 be raised at the chest diaphragm with respect to the resting surface at the neck zone.

This effect is attainable, e.g., graduating the softness of the various sections forming the main body, or even merely providing that the main body 2 have a thickness at the diaphragm that is greater with respect to the thickness at the neck zone.

With reference to the pillow structure, it has a covering preferably made of an anallergic and breathable cloth, in order to ensure maximum comfort.

In a preferred variant embodiment, the covering may be made of a natural fiber, e.g. of cotton, providing the required anallergic and transpiring features.

Moreover, there is provided a padding 9 that may be made of any suitable material known to a person skilled in the art.

This structure, common to all pillows, makes the pillow 1 substantially deformable, soft and elastic. In order to keep a substantially oval shape, said main body 2 has a structural element for keeping the oval shape.

This structural element may be obtained in various shapes. In particular, it may have a rigidity greater than that of the remaining portion of the main body.

According to the present embodiment, said structural element consists of an annular core 7 internal to the pillow main body 2 and located onto the section of the latter in a location substantially central or optionally shifted toward the resting base, indicated by 8. This annular core may be made of a rope-shaped or tubular element, and it may be merely ring-shaped or it may also comprise a cross-joint 10 crossing the secondary body 4.

Alternatively, the structural element comprises an annular layer of greater rigidity, located at a base portion of the main body. In any case, also the secondary body, it being anchored onto its respective ends to said pillow main body, may work as structural element for keeping said oval shape, optionally in cooperation with said annular core 7.

According to a further embodiment, the pillow 1 may also have, in the pillow main body 2, an elasticity and/or a softness decreasing from the chest-resting surface to the base portion.

In the present embodiment, the pillow secondary body 4 forms, with the pillow main body 2, a homogeneous resting surface 3 for the chest and a homogeneous base surface 8, without asperities or steps.

Moreover, during use, said resting surface is raised at the chest sides with respect to the resting surface at the neck zone. This effect may be attained in various ways, among which e.g. by providing that the main body 2 have a greater thickness at its side portions with respect to the thickness at the neck zone.

Moreover, in the present embodiment, the recesses 5 determined by the pillow main body 2 and secondary body 4 internally have concave side surfaces, producing for each recess 5 a cup shape, such as to naturally receive a breast shape.

FIG. 2 illustrates the employ of the above described pillow: positioned below the chest, it allows the inserting of a breast in the respective recess, and then the resting thereon assuming a prone position.

With this configuration, the body rests on the edges of the pillow main body 2 and, to a lesser extent, onto the secondary body. Thus, a woman's body assumes a correct posture, with the spine aligned on a horizontal plane. The slight level difference between diaphragm and top portion of the sternum allows unencumbered and comfortable breathing.

The breast assumes a natural position, unflattened and without stresses apt to cause discomfort or pain, in particular in the case of irritations, mastopathies, post-surgical hospitalization, as well as in everyday life.

It is understood that the above described pillow may be provided in different sizes, with particular reference to height and width, in order to fit different breast sizes and chest widths.

Among the variants within the reach of a person skilled in the art, it is worth mentioning a totally or partially inflatable embodiment, optionally with the employ of self-inflatable cells.

Moreover, a removable and easily washable covering may be provided.

In the light of the above, it is understood that a person skilled in the art could effect countless structural variants falling within the protective scope set forth by the following claims.

The invention claimed is:

1. A pillow suitable for a woman's body, comprising:

a substantially oval annular resilient pillow main body, having a central opening allowing breast insertion and a resting surface for the chest area surrounding the breast;

a resilient pillow secondary body of elongate shape, located transversely to the opening of the main body so as to position itself between the breasts, at the sternum, thereby defining a pair of recesses for the breasts, the recesses being tapered;

wherein the recesses are substantially evenly spaced apart from the oval outline form to provide support for a woman's breasts and diaphragm;

wherein the main body has a thickness at the woman's diaphragm is greater with respect to the thickness at the woman's neck zone so that said resting surface is raised at the woman's chest diaphragm with respect to the resting surface at the woman's neck zone during use.

2. The pillow according to claim 1, wherein the main body, being deformable, has a structural element for keeping the oval shape.

3. The pillow according to claim 2, wherein said structural element has a rigidity greater than that of the remaining portion of the main body.

4. The pillow according to claim 3, wherein said structural element consists of an annular core internal to the pillow main body and located onto the section of the main body in a substantially central location.

5. The pillow according to claim 4, wherein said annular core comprises a rope-shaped or tubular element.

6. The pillow according to claim 5, wherein said structural element comprises an annular layer of greater rigidity, located at the base portion of the main body.

7. The pillow according to claim 2, wherein said secondary body, being anchored onto its respective ends to said pillow main body, works as structural element for keeping said oval shape.

8. The pillow according to claim 1, wherein, in the pillow main body, the elasticity and/or the softness decreases from the chest resting surface to the base portion.

9. The pillow according to claim 1, wherein the pillow secondary body forms, with the pillow main body, a homogeneous resting surface for the woman's chest and a homogeneous base surface.

10. The pillow according to claim 1, wherein, during use, said resting surface is raised at the chest sides with respect to the surface at the neck zone.

11. The pillow according to claim 1, wherein the main body has a greater thickness at its side portions with respect to the thickness at the woman's neck zone.

12. The pillow according to claim 1, wherein the recesses determined by the pillow main body and secondary body internally have concave side surfaces, producing a cup shape for each recess.

13. The pillow according to claim 1, wherein, said main body and said secondary body are covered with a substantially an allergic fabric.

14. The pillow according to claim 13, wherein, said main body and said secondary body are covered with a substantially transpiring fabric.

15. The pillow according to claim 14, wherein, said main body and said secondary body are covered with a substantially natural fiber-based fabric.

16. The pillow according to claim 15, wherein, said fabric is cotton.

* * * * *